US009538858B2

(12) United States Patent
Rajagopalan

(10) Patent No.: US 9,538,858 B2
(45) Date of Patent: Jan. 10, 2017

(54) DUAL TEMPERATURE REFRIGERATED DISPLAY CASE

(71) Applicant: Hussmann Corporation, Bridgeton, MO (US)

(72) Inventor: Anand G. Rajagopalan, Anaheim, CA (US)

(73) Assignee: Hussmann Corporation, Bridgeton, MO (US)

( * ) Notice: Subject to any disclaimer, the term of this patent is extended or adjusted under 35 U.S.C. 154(b) by 605 days.

(21) Appl. No.: 13/797,484

(22) Filed: Mar. 12, 2013

(65) Prior Publication Data

US 2014/0260411 A1 Sep. 18, 2014

(51) Int. Cl.
*A47F 3/04* (2006.01)

(52) U.S. Cl.
CPC ..... *A47F 3/0447* (2013.01)

(58) Field of Classification Search
CPC .... A47F 3/0413; A47F 3/0452; A47F 3/0491; A47F 3/0447; F25D 11/02; F25D 11/022; F25D 13/02; F25D 13/04; F25D 21/08
USPC ..... 62/249, 252, 255, 256, 441, 448
See application file for complete search history.

(56) References Cited

U.S. PATENT DOCUMENTS

| | | | | |
|---|---|---|---|---|
| 2,490,413 | A * | 12/1949 | Burtis | 62/249 |
| 2,495,554 | A * | 1/1950 | Spangler | 62/252 |
| 2,836,039 | A * | 5/1958 | Weber | 62/252 |
| 3,063,252 | A * | 11/1962 | Lamb | 62/234 |
| 3,324,676 | A * | 6/1967 | Gerweck | 62/256 |
| 5,675,983 | A | 10/1997 | Ibrahim | |
| 6,742,344 | B2 * | 6/2004 | Vormedal | 62/89 |
| 7,062,932 | B2 * | 6/2006 | Downs | 62/255 |
| 2005/0217297 | A1 * | 10/2005 | Wilson | 62/255 |
| 2006/0168978 | A1 * | 8/2006 | Suda et al. | 62/251 |
| 2008/0141690 | A1 * | 6/2008 | Behr | 62/186 |
| 2009/0215381 | A1 | 8/2009 | Swofford | |
| 2009/0314021 | A1 * | 12/2009 | Higgs | 62/255 |
| 2010/0024446 | A1 | 2/2010 | Rohrer et al. | |
| 2010/0058789 | A1 | 3/2010 | Barreto et al. | |
| 2011/0259031 | A1 | 10/2011 | Anderson et al. | |
| 2011/0314857 | A1 | 12/2011 | Berben et al. | |
| 2012/0042675 | A1 | 2/2012 | Stephens et al. | |

* cited by examiner

*Primary Examiner* — Tho V Duong
*Assistant Examiner* — Raheena Rehman
(74) *Attorney, Agent, or Firm* — Michael Best & Friedrich LLP

(57) ABSTRACT

A dual temperature refrigerated display case including a low temperature refrigerated display case defining a low temperature product display area and including a low temperature air curtain configured to flow across an access opening of the low temperature case. The dual temperature refrigerated display case also includes a medium temperature refrigerated display case disposed above the low temperature case. The medium temperature case defines a medium temperature product display area and includes a medium temperature air curtain configured to flow across an access opening of the medium temperature case. The dual temperature refrigerated display case includes a duct disposed between the medium temperature refrigerated display case and the low temperature refrigerated display case. The duct receives spillover air from the medium temperature air curtain and redirects the spillover air away from the low temperature air curtain.

20 Claims, 4 Drawing Sheets

DUAL TEMPERATURE REFRIGERATED DISPLAY CASE

BACKGROUND

The present invention relates to a dual temperature refrigerated display case including a medium temperature open display case on top and a low temperature freezer open merchandizer on the bottom.

Dual temperature refrigerated display cases of this type have generally included separate air circulation systems providing cooled air to the display area of the medium temperature case on top and to the display area of the low temperature case on the bottom to maintain the products within each respective product display area at its desired temperature. The medium temperature case includes a fan and a medium temperature coil disposed in the base of the medium temperature case below the product display area. The fan draws air into an inlet at the front of the medium temperature case and then moves this air through the medium temperature coil. After passing through the coil, the air moves upwardly through a rear passageway behind the product display area, forwardly through an upper passageway above the product display area in the canopy, and downwardly out of a discharge outlet generating an air curtain across the front access opening of the product display area. Most of the air that defines the medium temperature air curtain is returned through the inlet to recirculate through the coil.

The low temperature case includes a fan and a low temperature coil disposed in the base of the low temperature case below the product display area. The fan draws air into an inlet at the front of the low temperature case and then moves this air through the low temperature coil. After passing through the coil, the air moves upwardly through a rear passageway behind the product display area, forwardly through an upper passageway above the product display area, and out of a discharge outlet at an angle generating an air curtain across an access opening of the product display area. Most of the air that defines the low temperature air curtain is returned through the inlet to recirculate through the coil.

Although stacking two different temperature cases in this manner provides advantages to marketing of product in a retail setting, it has provided challenges to maintaining case performance. For example, spillover air from the medium temperature air curtain (i.e., air which does not return to the medium temperature coil through the inlet) can dump into the low temperature case below thereby disrupting the low temperature air curtain allowing the intrusion of relatively humid, higher temperature air into the low temperature case causing potential issues in temperature performance within the low temperature case and frost formation on the low temperature coil. In the past, frost formation has been addressed through the addition of heaters on the low temperature coil. However, heaters, like other such energy producing components, add to the energy production of the case thereby decreasing case efficiency.

SUMMARY

The dual temperature display case of the present invention improves the performance of the freezer case and reduces the potential for frost formation on the low temperature coil by at least one of: (a) redirecting the spillover air from the medium temperature display case to provide a secondary air curtain over the low temperature air curtain; (b) redirecting the spillover air from the medium temperature display case away from interfering with the low temperature air curtain; and (c) configuring the air flow characteristics of the medium temperature case to substantially reduce the amount of spillover air leaving the circulation stream of the medium temperature case.

In one embodiment, the invention provides a dual temperature refrigerated display case including a low temperature refrigerated display case defining a low temperature product display area and including a low temperature air curtain configured to flow across an access opening of the low temperature case. The dual temperature refrigerated display case also includes a medium temperature refrigerated display case disposed above the low temperature case. The medium temperature case defines a medium temperature product display area and includes a medium temperature air curtain configured to flow across an access opening of the medium temperature case. The dual temperature refrigerated display case includes a duct disposed between the medium temperature refrigerated display case and the low temperature refrigerated display case. The duct receives spillover air from the medium temperature air curtain and redirects the spillover air away from the low temperature air curtain.

In another embodiment of the invention, a dual temperature refrigerated display case including a low temperature refrigerated display case defining a low temperature product display area and including a low temperature air curtain configured to flow across an access opening of the low temperature refrigerated display case. The dual temperature case includes a medium temperature refrigerated display case disposed above the low temperature refrigerated display case. The medium temperature case includes a bottom wall, a rear wall, and a top wall defining a forwardly-opening medium temperature product display area. The top wall includes perforations. The medium temperature case also includes an aft passageway located outside of the medium temperature product display area, a medium temperature cooling coil disposed in the air passageway, and a fan configured to move aft through the medium temperature cooling coil, through the air passageway, and downwardly out of the perforations. The medium temperature case further includes an inlet disposed in front of the product display area. The inlet is configured to receive the air discharged into the medium temperature product display area and deliver the air to the fan for recirculation. The medium temperature case also includes a shelf within the medium temperature product display area. The shelf extends forwardly from the rear wall, and the front end of each shelf includes a vertical passageway for conveying refrigerated air discharged into the medium temperature product display area, through the shelf, and toward the inlet. The perforations and the vertical passageway are configured to inhibit spillover air discharged into the medium temperature product display area and not returned through the inlet from disturbing the integrity of the low temperature air curtain.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
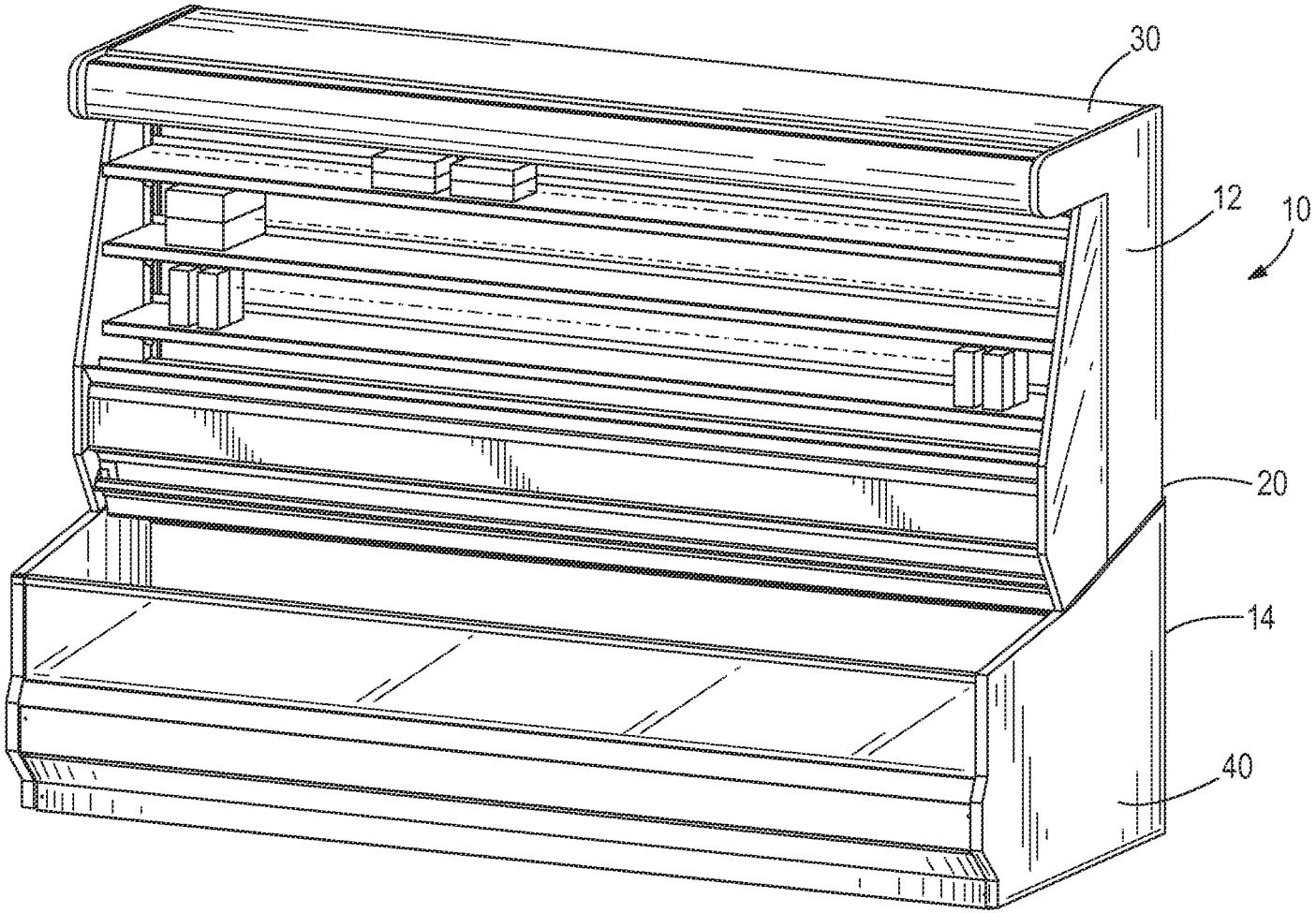
FIG. 1 is a perspective view of a dual temperature case of the present invention.
Figure 2:
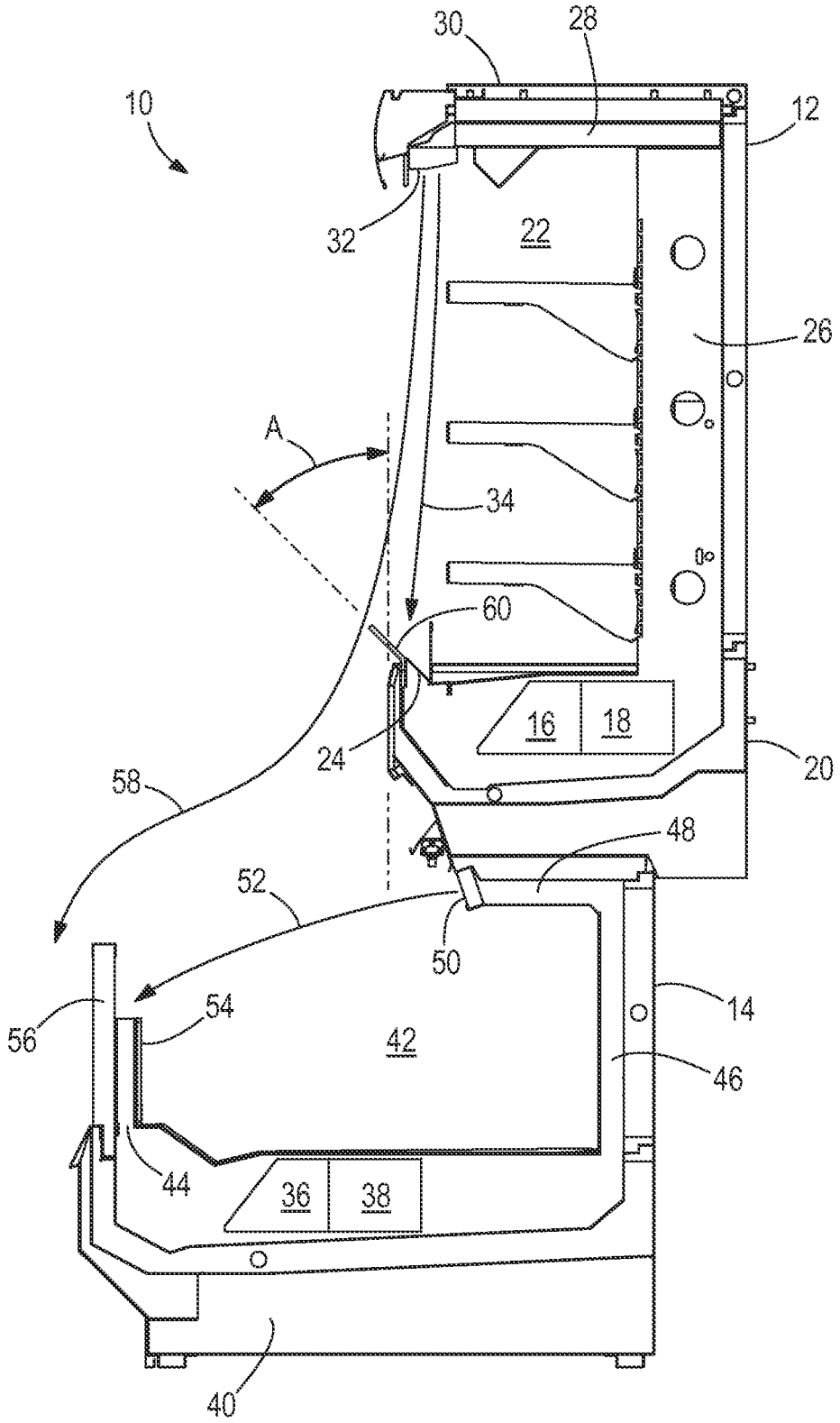
FIG. 2 is a schematic view of one construction of the dual temperature case of FIG. 1.

A first construction of the dual temperature refrigerated display case 10 is illustrated in FIGS. 1 and 2 and uses the spillover return air from the top medium temperature case to form a secondary air curtain over the lower freezer case.

As shown in FIG. 2, the dual temperature refrigerated display case 10 includes a medium temperature case 12 on top and a low temperature case 14 on the bottom. The medium temperature case 12 includes a fan 16 and a medium temperature cooling coil 18 disposed in a base 20 of the medium temperature case 12 below a product display area 22. The fan 16 draws air into an inlet 24 at the front of the medium temperature case 12 and then moves this air through the medium temperature coil 18. After passing through the coil 18, the air moves upwardly through a rear passageway 26 behind the product display area 22, forwardly through an upper passageway 28 above the product display area 22 in the canopy 30, and downwardly out of a discharge outlet 32 generating an air curtain 34 across the front of the product display area 22. Most of the air that defines the medium temperature air curtain 34 is returned through the inlet 24 to recirculate through the coil 18.

The low temperature case 14 includes a fan 36 and a low temperature cooling coil 38 disposed in the base 40 of the low temperature case 14 below a product display area 42 of the low temperature case 14. The fan 36 draws air into an inlet 44 at the front of the low temperature case 14 and then moves this air through the low temperature coil 38. After passing through the coil 38, the air moves upwardly through a rear passageway 46 behind the product display area 42, forwardly through an upper passageway 48 above the product display area 42, and out of a discharge outlet 50 at an angle generating an air curtain 52 across an access opening of the product display area 42. Most of the air that defines the low temperature air curtain 52 is returned through the inlet 44 to recirculate through the coil 38. The returned air passes between vertically-oriented inner and outer deflectors 54, 56.

The primary air curtain 34 from the medium temperature case 12 will preserve the performance of the medium temperature case 12. The primary air curtain 52 from the low temperature 14 case will preserve the performance of the low temperature case 14. The dual temperature case 10 is configured such that the spillover air 58 from the primary air curtain 34 of the medium temperature case 12 forms a secondary air curtain over the low temperature case without creating a dumping effect as described above. Specifically, the medium temperature case 12 includes a deflector 60 adjacent the inlet 24 to redirect a larger portion of the primary air curtain 34 of the medium temperature case 12 such that less spillover air 58 falls to the low temperature case 14. In addition, the deflector 60 changes the flow path of the spillover air 58 such that it follows outside of the primary air curtain 52 of the low temperature case 14 thereby forming a secondary air curtain for the low temperature case 14 to further inhibit the intrusion of the ambient air into the air being circulated through the low temperature case 14.

The deflector 60 projects upwardly and outwardly from the front of the inlet 24 at an included angle A of approximately 45 degrees relative to a vertical plane defined by the lower portion of the medium temperature case 12. The deflector 60 can be made from a clear material such as glass, acrylic, or polycarbonate. The tip of the deflector 60 projects forwardly beyond the vertical plane. In other constructions, the deflector 60 is non-parallel with the plane. In yet other constructions, the deflector 60 defines an included angle A of less than 50 degrees. Using the deflector 60 to redirect the spillover air 58 such that it defines a secondary air curtain to the low temperature case 14 creates a barrier, for warmer, moister air from entering the low temperature case 14 thereby reducing the case energy consumption. Additionally, the secondary air curtain reduces frost in the low temperature coil 38 and thereby also further enhances energy performance. In other constructions of the invention, different angles and lengths of the deflector 60 can also be used.

Figure 3A:
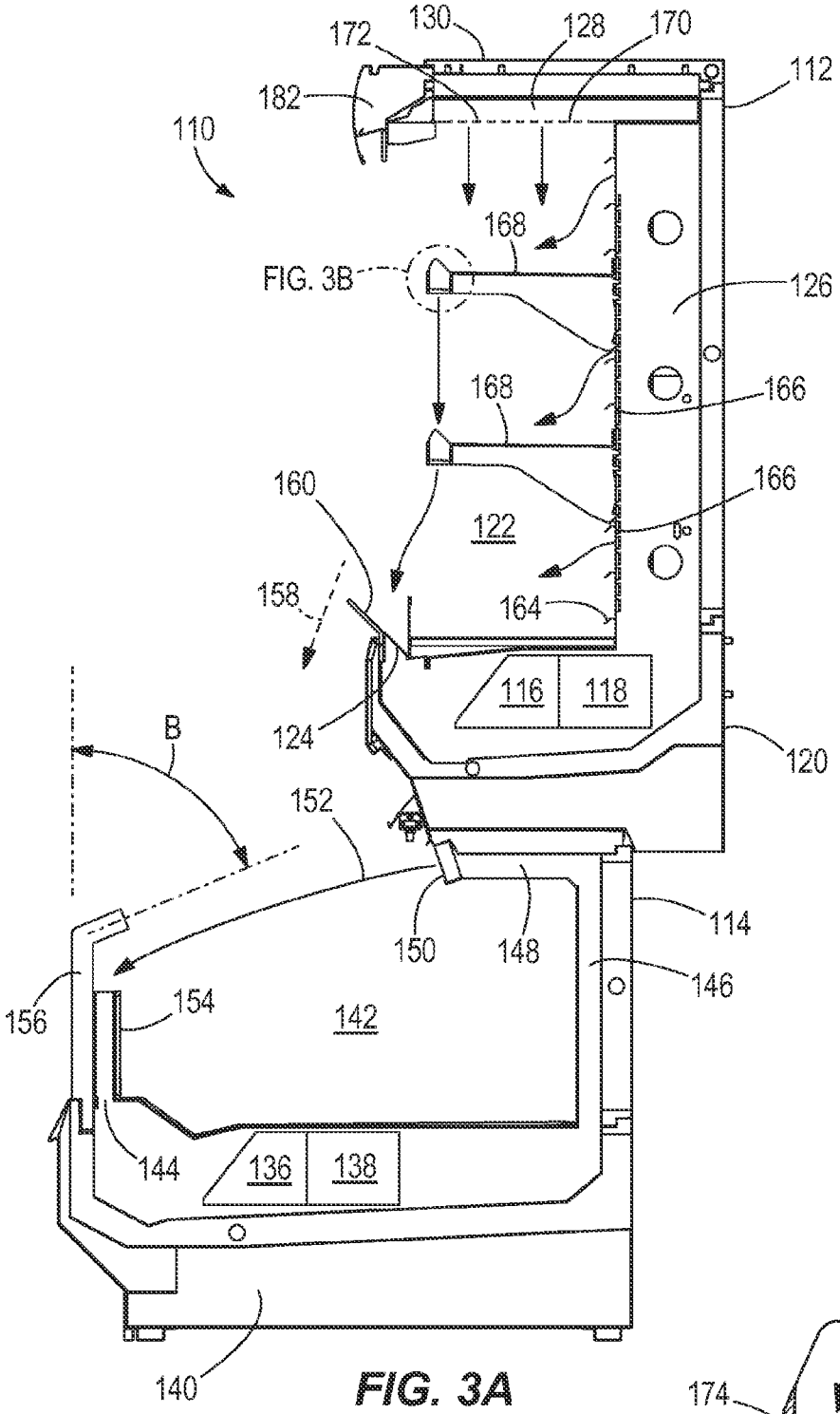
FIG. 3A is a schematic view of one construction of the dual temperature case of FIG. 1.

A second construction of the dual temperature refrigerated display case 110 is illustrated in FIG. 3A and is configured such that the air flow characteristics of the medium temperature case 112 substantially reduce the amount of spillover air 162 leaving the circulation stream of the medium temperature case 112. The dual temperature display case 110 uses an air discharge and air return system on the medium temperature case 112 that that manages the air discharge and return at each shelf level. Similar reference numbers, although incremented by 100, are used for features common to those described above for the construction in FIG. 2.

Instead of generating a primary air curtain 34 through a discharge 32 of the construction of FIG. 2, the dual temperature case 110 instead discharges air from the medium temperature coil 118 through downwardly-directed louvers 164 of the rear wall 166 into the product display area 122. This discharged air is slowly distributed into each shelf area, i.e., the space located above each shelf 168. In addition, the air from the medium temperature coil 118 is discharged through perforations 170 in the top wall 172 of the case 112 into the product display area 122. This discharged air creates a sprinkler effect on the air flow from the top.

Figure 3B:
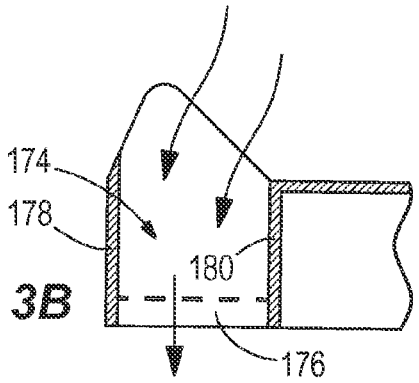
FIG. 3B is a cross-section of an end of a shelf of the dual temperature case of FIG. 3A.

With reference to FIG. 3B, the front of each shelf 168 includes a vertical passage 174 that directs the air above the shelf 168 toward the inlet 124 below the shelf 168. The vertical passages 174 help to maintain the air within the medium temperature display case 112 to increase the amount of air recirculated back to the medium temperature coil 118 thereby decreasing the amount of spillover air 158 to the low temperature refrigerated display case 114. The vertical passages 174 can include fans 176 to assist in pulling the air through the shelves 168. Each vertical passage 174 is defined by an outer wall 178 and an inner wall 180 on the shelf 168.

Additionally, the front section 182 of the case 112 is lowered to inhibit infiltration of ambient air at the top of the product display area 122. The front section 182 extends approximately between 25% to 50% of the distance between the top wall 172 and the top surface of the top shelf 168. More specifically, the front section 182 extends at least 25% of the distance between the top wall 172 and the top surface of the top shelf 168. In other constructions of the invention, the front section 182 can be extended to different lengths.

With reference to FIG. 3A, the low temperature case 114 is also modified such that the return air outer deflector 156 includes a portion that is angled back toward the discharge outlet 150 of the air curtain 152. The deflector 156 projects upwardly and inwardly from the front of the low temperature refrigerated display case 114 at an included angle B of approximately 50 degrees relative to a vertical plane. The angled portion of the deflector 158 is between two and three inches long. The angle and length of the deflector preserves the air of the lower temperature case 114 and also maintains the necessary pressure differential between discharge and return of the low temperature case 114. In other constructions of the invention, different angles and lengths of the deflector can also be used.

Figure 4:
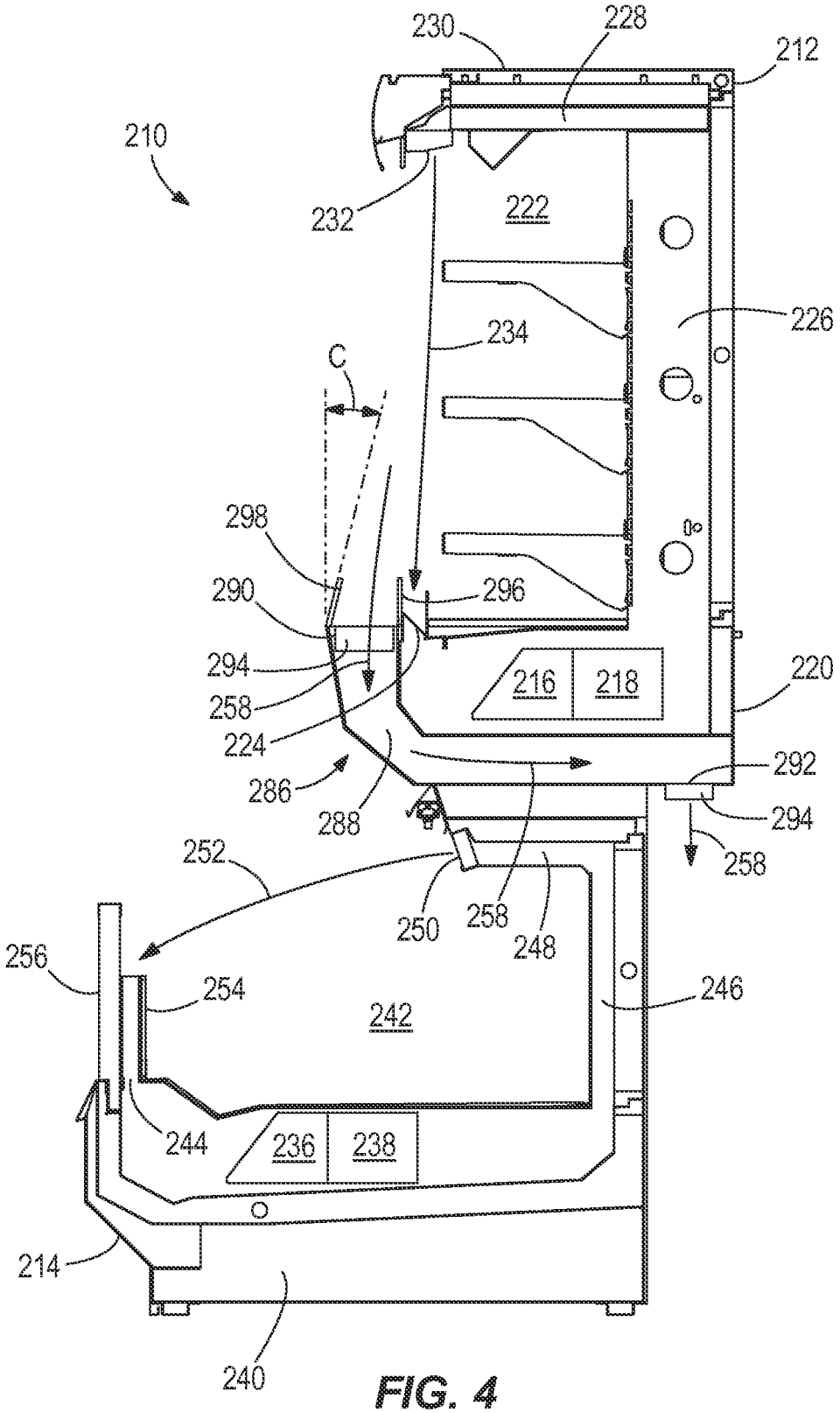
FIG. 4 is a schematic view of another construction of the dual temperature case of FIG. 1.

A third construction of the dual temperature refrigerated display case 210 is illustrated in FIG. 4 and redirects the spillover air 258 from the medium temperature display case 212 away from interfering with the low temperature air curtain 252. The dual temperature display case 210 uses a dispersion system 286 that removes the spillover air 258 and redirects it between the medium temperature case 212 and the low temperature case 214 and then behind the low temperature case 214. Similar reference numbers, although incremented by 200, are used for features common to those described above for the construction in FIG. 2.

As shown in FIG. 4, the dispersion system 286 includes a duct 288 that will collect spillover air 258 from the medium temperature case 212 and divert the air to the back of the low temperature case 214 to mix with the ambient air. The duct 288 extends from the front of the medium temperature case 212 adjacent the inlet 224, around the bottom of the medium temperature case 212, and extends between the medium temperature case 212 and the low temperature case 214. The duct 288 has a duct inlet 290 outside and adjacent the medium temperature case inlet 224 and a duct outlet 292 positioned at the bottom rear of the medium temperature case 212 opening toward the space located behind the low temperature case 214. The duct 288 may include one or more fans 294 to propel or draw the spillover air 258 through the duct 288. For example, a fan 294 can be located at the outlet 292 of the duct to draw spillover air into the inlet 290 of the duct 288 and to disperse the spillover air 258 out of the outlet 292 and into the space behind the low temperature case 214. As another example, a fan 294 can be located adjacent the duct inlet 290 and used in addition to or instead of the fan 294 positioned at the duct outlet 292.

The medium temperature case 210 includes a vertically-oriented inner deflector 296 between the inlet 224 and the inlet 290, and an outer deflector 298 positioned outside and adjacent the inlet 290. The outer deflector 298 projects upwardly and inwardly from the front of the medium temperature refrigerated display case 212 at an included angle C of approximately 15 degrees relative to a vertical plane defined by the lower portion of the medium temperature case 212. In other constructions of the invention, different angles and lengths of the deflectors 296, 298 can also be used.

Various features and advantages of the invention are set forth in the following claims.

What is claimed is:

1. A dual temperature refrigerated display case comprising:

a low temperature refrigerated display case defining a low temperature product display area and including a low temperature air curtain configured to flow across an access opening of the low temperature refrigerated display case;

a medium temperature refrigerated display case disposed above the low temperature refrigerated display case, the medium temperature refrigerated display case defining a medium temperature product display area and including a medium temperature air curtain configured to flow across an access opening of the medium temperature refrigerated display case; and a dispersion system including a duct disposed between the medium temperature refrigerated display case and the low temperature refrigerated display case, the duct receiving spillover air from the medium temperature air curtain and redirecting the spillover air to an exterior of the medium temperature refrigerated display case away from the medium temperature access opening.

2. The dual temperature refrigerated display case of claim 1, wherein the duct includes a fan to move the spillover air through the duct and away from the low temperature air curtain.

3. The dual temperature refrigerated display case of claim 2, wherein the duct includes an inlet and an outlet, and wherein the fan is located at the inlet.

4. The dual temperature refrigerated display case of claim 2, wherein the duct includes an inlet and an outlet, and wherein the fan is located at the outlet.

5. The dual temperature refrigerated display case of claim 1, wherein the duct includes an inlet and an outlet, and wherein duct includes a first fan located at the inlet and a second fan located at the outlet.

6. The dual temperature refrigerated display case of claim 1, wherein the duct includes an inlet and wherein the medium temperature refrigerated display case includes a deflector positioned between the inlet of the duct and an inlet of the medium temperature refrigerated display case, wherein the deflector is oriented vertically.

7. The dual temperature refrigerated display case of claim 1, wherein the duct includes an inlet and wherein the medium temperature refrigerated display case includes a deflector positioned in front of the inlet of the duct, wherein the deflector is angled upwardly and inwardly.

8. The dual temperature refrigerated display case of claim 1, wherein the duct is configured to receive spillover air from the medium temperature air curtain and redirect the spillover air away from the low temperature air curtain and behind the low temperature refrigerated display case.

9. The dual temperature refrigerated display case of claim 1, wherein the duct is configured to receive spillover air from the medium temperature air curtain and redirect the spillover air away from the low temperature air curtain and below the medium temperature refrigerated display case.

10. The dual temperature refrigerated display case of claim 1, wherein the duct is configured to divert the spillover air away from the low temperature refrigerated display case and the medium temperature refrigerated display case.

11. A dual temperature refrigerated display case comprising:

a low temperature refrigerated display case defining a low temperature product display area and including a low temperature air curtain configured to flow across an access opening of the low temperature refrigerated display case; and a medium temperature refrigerated display case disposed above the low temperature refrigerated display case, the medium temperature refrigerated display case including a bottom wall, a rear wall, and a top wall defining a forwardly-opening medium temperature product display area, wherein the top wall includes perforations, an air passageway located outside of the medium temperature product display area, a medium temperature cooling coil disposed in the air passageway, a fan configured to move air through the medium temperature cooling coil, through the air passageway, and downwardly out of the perforations, an inlet disposed in front of the product display area configured to receive the air discharged into the medium temperature product display area and deliver the air to the fan for recirculation, a shelf within the medium temperature product display area, wherein the shelf extends forwardly from the rear wall and wherein a front end of the shelf includes spaced apart walls defining a vertical passageway disposed adjacent the front of the shelf for conveying refrigerated air discharged into the medium temperature product display area through the shelf and toward the inlet, wherein the perforations and the vertical passageway are configured to inhibit spillover air discharged into the medium temperature product display area not returned through the inlet from disturbing the integrity of the low temperature air curtain.

12. The dual temperature refrigerated display case of claim 11, wherein the perforations are evenly distributed across the top wall.

13. The dual temperature refrigerated display case of claim 11, wherein the rear wall includes downwardly-directed louvers, and the fan is configured to move air downwardly out of the downwardly-directed louvers.

14. The dual temperature refrigerated display case of claim 11, wherein the medium temperature refrigerated display case includes at least one additional shelf within the medium temperature product display area, wherein the at least one additional shelf extends forwardly from the rear wall and wherein the front end of the at least one additional shelf includes a vertical passageway for conveying refrigerated air discharged into the medium temperature product display area, through the shelf, and toward the inlet.

15. The dual temperature refrigerated display case of claim 14, wherein the shelf and the at least one additional shelf includes a fan disposed in the vertical passageway for moving air discharged into the medium temperature product display area, through the shelf, and toward the inlet.

16. The dual temperature refrigerated display case of claim 11, wherein the shelf includes a fan disposed in the vertical passageway for moving air discharged into the medium temperature product display area, through the shelf, and toward the inlet.

17. The dual temperature refrigerated display case of claim 11, wherein the low temperature refrigerated display case includes a deflector positioned at the front of the low temperature refrigerated display case, wherein the deflector is angled upwardly and inwardly.

18. The dual temperature refrigerated display case of claim 11, wherein the medium temperature case includes a deflector adjacent the inlet, wherein the deflector is angled upwardly and outwardly.

19. A dual temperature refrigerated display case comprising:

a low temperature refrigerated display case defining a low temperature product display area and including a low temperature air curtain configured to flow across an access area of the low temperature refrigerated display case;

a medium temperature refrigerated display case disposed above the low temperature refrigerated display case, the medium temperature refrigerated display case defining a medium temperature product display area and including a medium temperature air curtain configured to flow across an access area of the medium temperature refrigerated display case and a first inlet in fluid communication with a cooling coil and configured to receive air from the medium temperature refrigerated display case; and a duct disposed between the medium temperature refrigerated display case and the low temperature refrigerated display case, wherein the duct includes a second inlet configured to receive spillover air from the medium temperature refrigerated display case and to direct the spillover air away from the low temperature air curtain and the medium temperature refrigerated display case so that at least a portion of the spillover air is not recirculated within the medium temperature refrigerated display case.

20. The dual temperature refrigerated display case of claim 19, wherein the duct is configured to move the spillover air exterior to the refrigerated display case.

* * * * *